United States Patent [19]

Andersson et al.

[11] Patent Number: 4,978,069

[45] Date of Patent: Dec. 18, 1990

[54] METHOD AND APPARATUS FOR THE FORMATION OF DROPLETS

[76] Inventors: Ralf Andersson, Frostgatan 88; Alf Andersson, Centralgatan 9, both of S-260 35 Ödåkra, Sweden

[21] Appl. No.: 411,478

[22] PCT Filed: Mar. 25, 1988

[86] PCT No.: PCT/SE88/00145

§ 371 Date: Oct. 16, 1989

§ 102(e) Date: Oct. 16, 1989

[87] PCT Pub. No.: WO88/07414

PCT Pub. Date: Oct. 6, 1988

[30] Foreign Application Priority Data

Mar. 27, 1987 [SE] Sweden ..... 8701274

[51] Int. Cl.[5] ..... B05B 5/04

[52] U.S. Cl. ..... 239/224; 239/214; 239/222

[58] Field of Search ..... 239/214, 222, 223, 224, 239/700, 701, 702, 703, 245

[56] References Cited

U.S. PATENT DOCUMENTS

| | | | |
|---|---|---|---|
| 1,506,226 | 8/1924 | Dick | 239/245 |
| 3,017,116 | 1/1962 | Norris | 239/702 |
| 3,171,600 | 3/1965 | Eckey | 239/224 |
| 3,197,143 | 7/1965 | Norris | 239/702 |
| 3,452,931 | 7/1969 | Knowles | 239/222 |
| 4,458,844 | 7/1984 | Mitsui | 239/223 |

FOREIGN PATENT DOCUMENTS

| | | | |
|---|---|---|---|
| 2004205 | 3/1979 | United Kingdom | 239/223 |

*Primary Examiner*—Michael S. Huppert
*Assistant Examiner*—Christopher G. Trainor
*Attorney, Agent, or Firm*—Brooks & Kushman

[57] ABSTRACT

A method and an apparatus for dividing a liquid into droplets is disclosed. One or several disks (35) rotate about an axis (A) and are provided, at their outer peripheral edges, with circumferentially equidistant, uniform cusps. A distributing device (20) is adapted to distribute the liquid uniformly and circumferentially on the disks (35), whereby the liquid discharged onto the disks (35) is formed into a uniform thickness film which spreads radially outwardly towards the cusps (36) and is divided thereby into uniform size droplets. The distributing device (20) may comprise a dosing container (21) which is rotationally independent of the disks (30) and from which the liquid is dosed through one or several dosing openings (26) onto the disk or disks (35), the disks (35) preferably being rotated relative to the dosing openings (26).

15 Claims, 5 Drawing Sheets

METHOD AND APPARATUS FOR THE FORMATION OF DROPLETS

Figure 1:
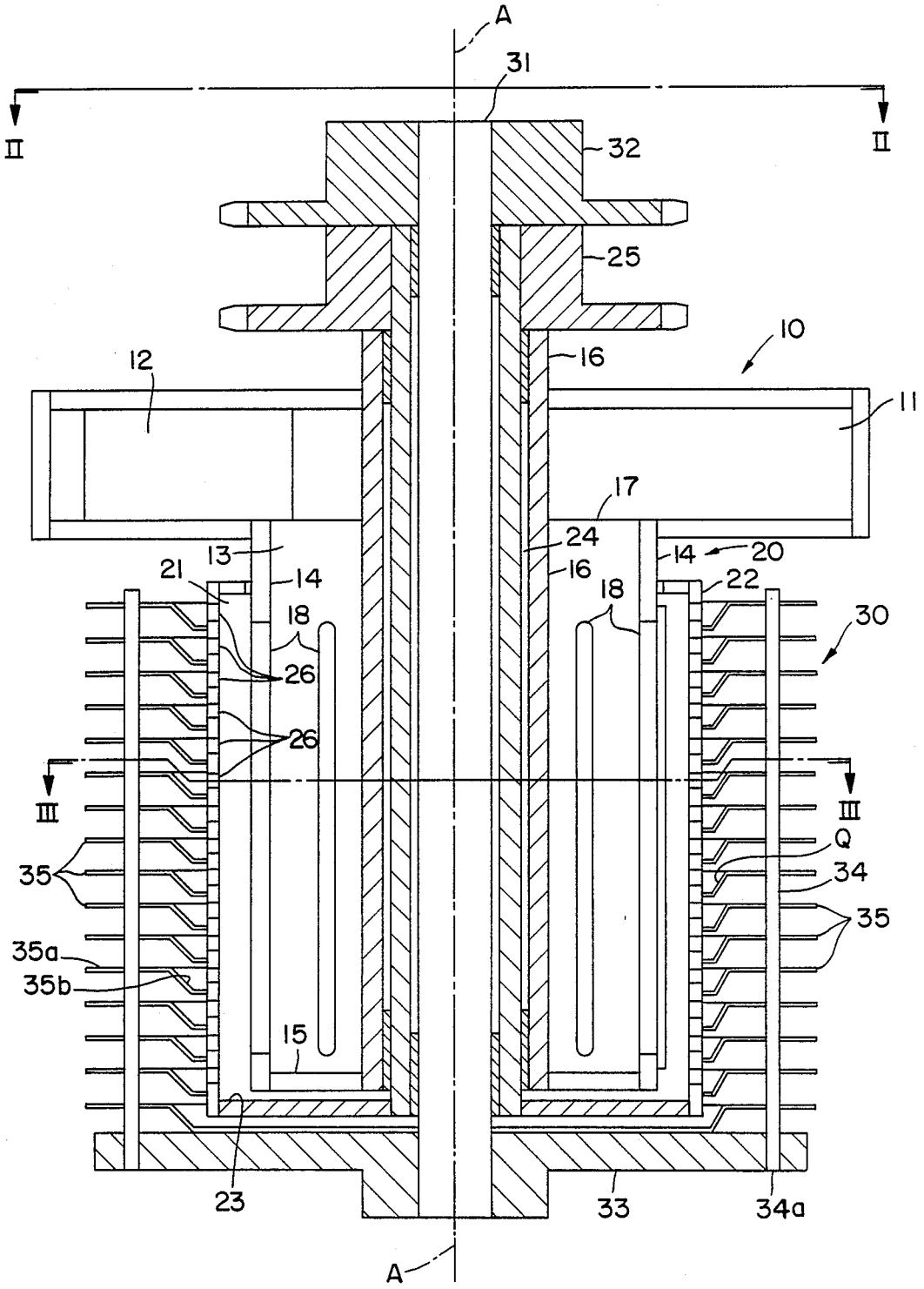

The present invention relates to a method and an apparatus for dividing a liquid into droplets. More particularly, the invention relates to droplet formation methods and apparatuses of the type where droplets are slung from a droplet formation apparatus by centrifugal action.

One application of the invention is the formation of nonyielding spherical granules from a liquid material, such as a melt, during which the droplets formed according to the invention are slung by centrifugal action in the nonsolidified state from a droplet formation apparatus and are subsequently subjected, for example in a descending motion, to a solidification process in a solidification zone.

The term melt is used hereinafter for all types of substances in liquid or semiliquid form, optionally containing suspended or dispersed particles capable of solidifying (for example by changes in temperature, drying or chemical processes) into spherical granules during their subsequent passage through a solidification zone.

In other applications of the invention, the droplets are formed of a liquid which does not undergo solidification after the droplet formation. One such application is, for example, gas purification of the type in which the gas to be purified is caused to pass through a "cloud" of liquid droplets removing impurities from the gas. Another application is painting/spray painting. Furthermore, air-drying and the distribution of fuel in burners may be mentioned as examples of conceivable applications of this invention.

The prior art technique within the first-mentioned application of the invention, i.e. the formation of spherical granules from a melt, comprises for example the production of urea for fertilizers, carbamide and ammonium nitrate, where it is desired to have a final product in the form of small spherical granules. A great many droplet formation methods and apparatuses have been developed for this purpose, the main object of which was to produce uniform size spheres, i.e. uniform size droplets of the melt. Such droplet formation apparatuses are usually mounted in the upper part of a so-called prilling tower through which a cooling air flow is directed upwards against the descending droplets.

A more uniform diameter relationship of such droplets implies a number of production and environmental improvements. Spreading the droplet diameter, on the other hand, implies that the material must be remelted to a large extent. Furthermore, undersized droplets could give rise to undesired air pollutants because the undersized droplets are carried along in the form of aerosols by the exhaust air and cause odour problems in the surroundings, fallout, and other environmental hazards.

Many known production methods and droplet formation apparatuses are based on the principle that a melt is supplied to a perforated and, optionally, rotating cylindrical surface or the like which they leave in the form of droplets. Obviously, such a technique requires a constant flow to each perforation of the surface and a constant flow leaving each such perforation, and obviously this known technique depends heavily upon a uniform size hole diameter across the entire perforated surface at a given viscosity.

SE 7206000-7 proposes, for example, that the passages in a droplet-forming disk should be coated with a layer of epoxy plastic to prevent clogging of the droplet-forming passages.

SE 7402820-0 discloses the use of a rotating perforated container from which a melt is slung out through radial holes in the container wall and thus is divided into droplets. According to this patent, the liquid material is supplied in the form of annular laminar flows, each individual flow being conducted towards vertically spaced apart areas comprising rows of holes.

NO 170,270 endeavours to solve the above-mentioned clogging problem by means of a centrifuge for spraying liquid material, such as a melt, through a rotating perforated wall, the container of the centrifuge accommodating a body which presents rotation symmetry and whose surface facing the centrifuge wall has essentially the same form of rotation as the wall of the centrifuge container, said body being so dimensioned that there is formed, between the body and the inside of the centrifuge container, a relatively narrow annular space having a width of, for example, 20 mm. The patent also proposes that the said inner body be formed with discharge openings, such that a melt can be introduced into the interior of the body from above and flow out through the discharge openings into the annular space and from there through the perforations of the centrifuge container.

The above-mentioned prior art apparatuses are all based on the use of a perforated and, optionally, rotating surface for the formation of droplets, and all of them endeavour to solve the problem of providing a highly exact flow to and out of each of the openings in the perforated surface. Although certain improvements could be realized, there is as yet no satisfactory solution to the problem.

Besides the above-mentioned problem of forming uniform size droplets, known technique is aware of a further difficulty, and this is that the particles slung from the rotating perforated surface of the droplet formation apparatus are not spherical, as is preferred, but more or less drop-shaped or elongate. The reason why the particles are given a nonspherical shape is that the droplets are formed from threads or jets of melt. Each new slung-out particle is "born" by cutting off the extreme end of a "strand" across a section having a fairly large circumference. It was also found that such droplet formation from jets produces several different droplet sizes, which is due to the fact that one has no control of the point where the droplet is cut off from the melt jet.

To solve the said clogging problem, it has also been suggested to increase the diameter of the droplet-forming holes or passages. Since the amount of melt supplied to each hole will thus increase, the droplet diameter will increase as well, and the result of this technique are droplets having a diameter which is larger than desired.

A considerable disadvantage of the prior art methods and apparatuses for the formation of droplets from a melt thus is that the droplet diameter varies to a nonpermissible degree.

A further disadvantage of prior technique is that the melt particles slung from the disk are more or less drop-shaped because particles slung from a perforated rotating surface are formed by cutting off jets or threads from the melt, whereby the final product obtains an undesired nonspherical shape.

A third disadvantage of the prior technique of forming droplets from a melt is that the amount of droplet material cannot be controlled per unit of time, while simultaneously maintaining an unchanged droplet size.

Having thus reviewed some known techniques for producing spherical granules from a melt, and the disadvantages associated therewith, it is appropriate to give a similar account of the above-mentioned applications of the invention where the droplets formed are not solidified.

The wish for droplets of essentially uniform size exists also in many of the applications where the droplets are not subjected to solidification. In both gas purification and spray-painting, it is an advantage if one can produce a large number of relatively small droplets per unit of time, the smallest droplets being sufficiently large to prevent the formation of hazardous aerosols in exhaust gases.

Present-day techniques for, for example, gas purification impart to the resulting droplets which comprise, inter alia, the said aerosols, a nonuniform diameter relationship. This problem has not yet been solved because the problem of producing essentially uniform size droplets in a desired number per unit of time (for example millions of droplets/second) could not be solved either.

To simplify the continued description of the invention as regards the designation of the material to be divided into droplets, the term "liquid" as used above and hereinafter shall be considered to comprise all liquid or semiliquid materials permitting the formation of droplets according to the invention. In particular, the term "liquid" shall be considered to comprise also such melts as have been defined above.

It is the object of the present invention to provide a method and an apparatus which eliminate the shortcomings of prior art technique.

This and other objects of the invention have been achieved by an entirely new approach to the problem at issue. In accordance with the invention, the actual droplet formation does not utilize a perforated rotating surface. In this manner, the clogging problem of prior art technique and the problem of supplying a constant amount of liquid to each of the openings in the perforated surface are entirely eliminated.

The novel characteristic feature of the invention is that the liquid in the drop formation apparatus from which the droplets are slung by centrifugal action, is uniformly distributed in the circumferential direction relative to a geometrical axis on a disk, preferably several associated disks rotatable about said axis, the peripheral outer edge of each disk being provided with circumferentially equidistant, uniform and radially projecting portions called cusps hereinafter. According to the invention, the disk or disks are caused to rotate during discharge of the liquid, such that the liquid discharged onto each disk is formed into a uniform thickness film which, under centrifugal action, spreads radially outwardly towards said cusps and is divided thereby into uniform size droplets. In this manner, each droplet will detach itself from the corresponding cusp when, as a result of the increasing droplet size, the centrifugal force acting outwardly on the droplet, exceeds the corresponding inwardly directed force of adhesion.

In the present invention, the term "cusp" comprises also other types of radially projecting portions than conventional "saw-toothed" pointed cusps. Thus, the term "cusp" must be taken to comprise also (a) radially projecting closely spaced rods or the like, (b) radially projecting unpointed bulges, for example a wave-shaped peripheral edge of the disk or disks, (c) radially projecting portions whose height perpendicular to the plane of the disk is less than the thickness of the disk, which can be achieved for example by mounting two circular disks which have the same diameter and one of which has a periphery provided with cusps, while the other has a smooth periphery, with their main surfaces facing one another and with the cusp-bearing disk uppermost, such that the points of the cusps coincide with the peripheral edge of the lower disk, and (d) other radially projecting portions providing the liquid distribution effect according to the invention.

By the method according to the invention as described above, a direct formation of the droplets is achieved, in contrast to droplet formation from threads/jets according to prior art technique. The direct droplet formation implies that there is continuously "born" at each of said cusps a particle of the liquid from a defined surface having a relatively small periphery. In this manner, there is no cutting-off of a jet, and one obtains the spherical shape of the slung-out droplets.

The invention also comprises a droplet formation apparatus of the type mentioned by way of introduction, said apparatus being intended for the above-mentioned droplet formation method and being characterised by:

a disk means comprising at least one disk which is rotatable about a geometrical axis preferably perpendicular to the extent of the disk and whose outer peripheral edge is provided with circumferential equidistant, uniform and radially projecting portions designated cusps hereinbelow;

a distributing means adapted to distribute the liquid uniformly in the circumferential direction about the said axis, on the disk or disks of said disk means;

and drive means connected with the said disk means and adapted to cause said disk means to rotate about the axis during distribution of the liquid, such that the liquid discharged onto the disk or disks is formed into a uniform thickness film which spreads radially outwardly towards the said cusps and is divided thereby into uniform size droplets.

According to a presently preferred embodiment of the droplet formation apparatus according to the invention, the apparatus is characterised in that said disk means comprises a plurality of axially spaced apart and mutually held-together disks of the said type, said disks being provided each with a central opening, and that said distributing means comprises a dosing cylinder which is rotationally independent of said disk means and extended through the central openings of the disks, the circumferential wall of said dosing cylinder being formed with at least one, preferably several dosing openings at each disk.

With a droplet formation apparatus of the last-mentioned construction, both the droplet size and the total droplet-forming amount of material per unit of time can be controlled. By increasing or reducing the speed of rotation of the disk means, it is possible to respectively increase or reduce the centrifugal force acting on the droplets at the cusps, which means that droplets of varying diameters can be produced. On the other hand, it is possible, by controlling the speed of rotation of the dosing cylinder, to control the liquid amount dosed onto the disks per unit of time from the dosing openings.

It will be appreciated that, for the formation of uniform size droplets, it is not enough to use a disk whose outer peripheral edge is provided with cusps or the like, the liquid must also be extremely uniformly distributed in the circumferential direction on the disk or disks if one is to obtain a uniform thickness film on each disk, i.e. a uniform flow to each of said cusps is required.

To achieve such a uniform distribution of the liquid circumferentially on the disk or disks, the dosing cylinder is preferably caused to rotate at a speed different from the speed of rotation of the disk means. This can be achieved for example by rotating the distributing means and the disk means in opposite directions. Thus, it is important that the disk means and the distributing means are mutually rotated because this is a prior condition for supplying each point on the radially inner portions of the disks with a continuous liquid flow from the dosing openings. If the dosing openings do not rotate relative to the disks, only those points on the disks that lie outside a dosing opening will be supplied with a continuous liquid flow, and the result is a less uniform spread of the liquid film on each disk.

According to first variant of the droplet formation apparatus according to the invention, a stationary cylinder adapted to receive the liquid and having an outer diameter which is smaller than the inner diameter of the dosing cylinder, is coaxially mounted in the dosing cylinder, such that an annular space is formed between the inner stationary receiving cylinder and the rotating dosing cylinder. The circumferential wall of the inner cylinder has a plurality of substantially axially directed slots through which the liquid flows out into the annular space. The liquid forms, by centrifugal action, a layer on the inside of the rotating dosing cylinder, and the liquid in this layer is successively dosed out through the dosing openings onto the disks. A prior condition for uniform size droplets is that the amount of liquid dosed onto the disks is constant in time. This is achieved if the thickness of the said layer is maintained constant in time. In this variant of the invention, the stationary inner cylinder is provided, at each slot formed therein, with a radially projecting land on the side of the slot located in the direction of rotation of the dosing cylinder. These lands have a radial extent which is smaller than the width of said angular space, whereby the thickness of the liquid layer is limited to the distance between the lands and the inside of the dosing cylinder. The slot/land combination will also function as automatic throttling valves, as will be described in more detail hereinafter.

Other characteristic features and variants of the method and the apparatus according to the invention are defined by the appended claims.

An apparently related prior art technique is disclosed in WO 82/03024 which describes a method and an apparatus for quick-freezing molten particulate metal. A volatile cooling liquid is supplied to the centre of a disk rotating at high speed to form a radially outwardly flowing coolant film on the disk. The metal to be treated is supplied onto the coolant film at a radial distance from the disk centre. The molten metal supplied will thus be slung outwardly on the disk by centrifugal action, while it is quickly cooled by the coolant which is evaporated. However, this known technique which at first sight may seem to be near to the present invention, has an entirely different function and application and, besides, an entirely different purpose than the droplet formation apparatus according to the invention.

In the known apparatus for the production of metal particles, the material supplied to the disk solidifies while on the disk, and this must not be confused with the technique of the present invention, according to which the liquid supplied to the disk or disks is not solidified while it is on the disk. Indeed it is a prior condition for the droplet formation by the peripheral notches of the disk or disks that they receive the material in the liquid state and divide it into droplets which leave the droplet formation apparatus in the liquid state.

A further difference between the technique disclosed by WO 82/03024 and the technique of the present invention is that the latter effects an active distribution of the liquid in the circumferential direction on each disk, which is a prior condition for producing on each disk a liquid film which is absolutely uniform in thickness, and this in turn is a prior condition for a uniform and constant flow to the notches, such that uniform size droplets are formed. The WO publication does not disclose such an active distribution of the metal melt in the circumferential direction, and the metal melt is supplied to the disk at one point only which is spaced from the disk centre. In other words, the prior art according to WO 82/03024 is remote from the present invention, both in technical respect and in respect of its application.

Figure 2:
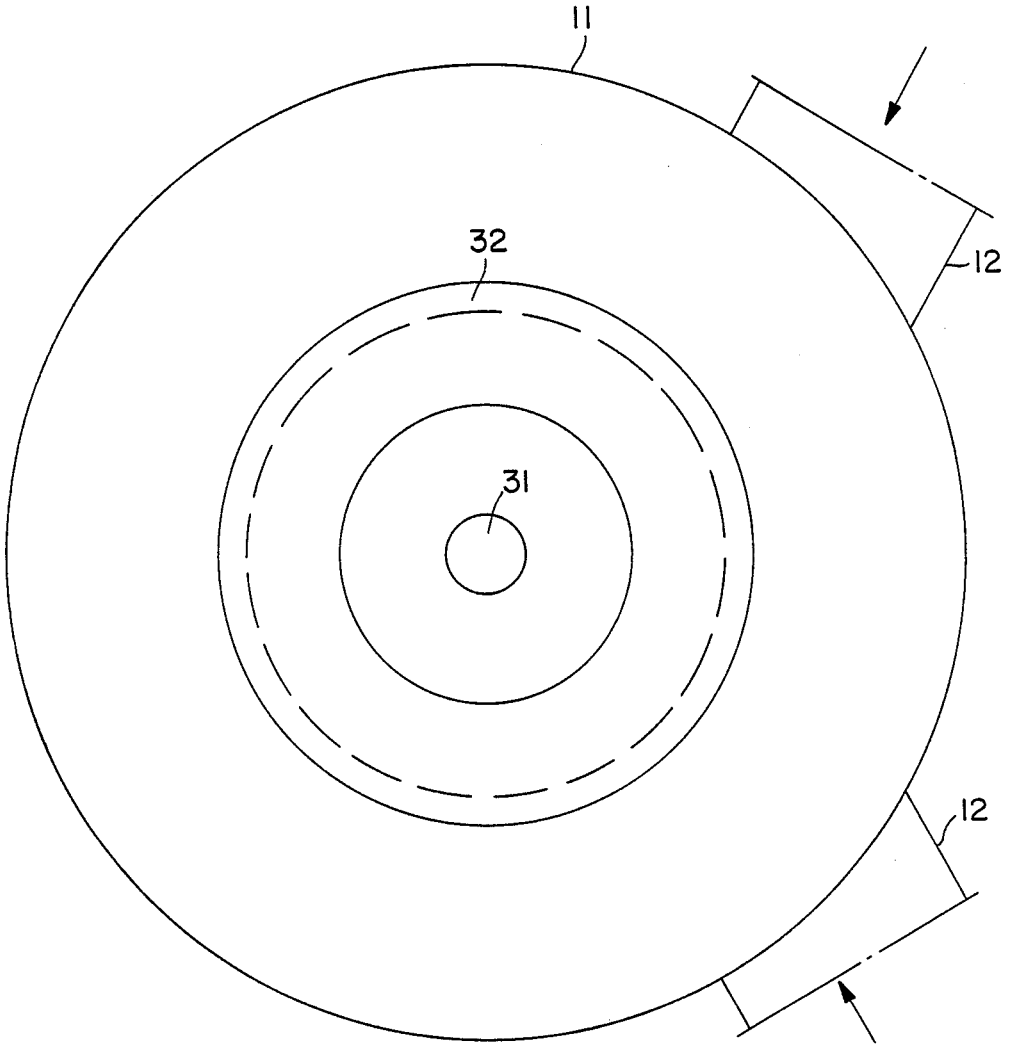
Figure 3:
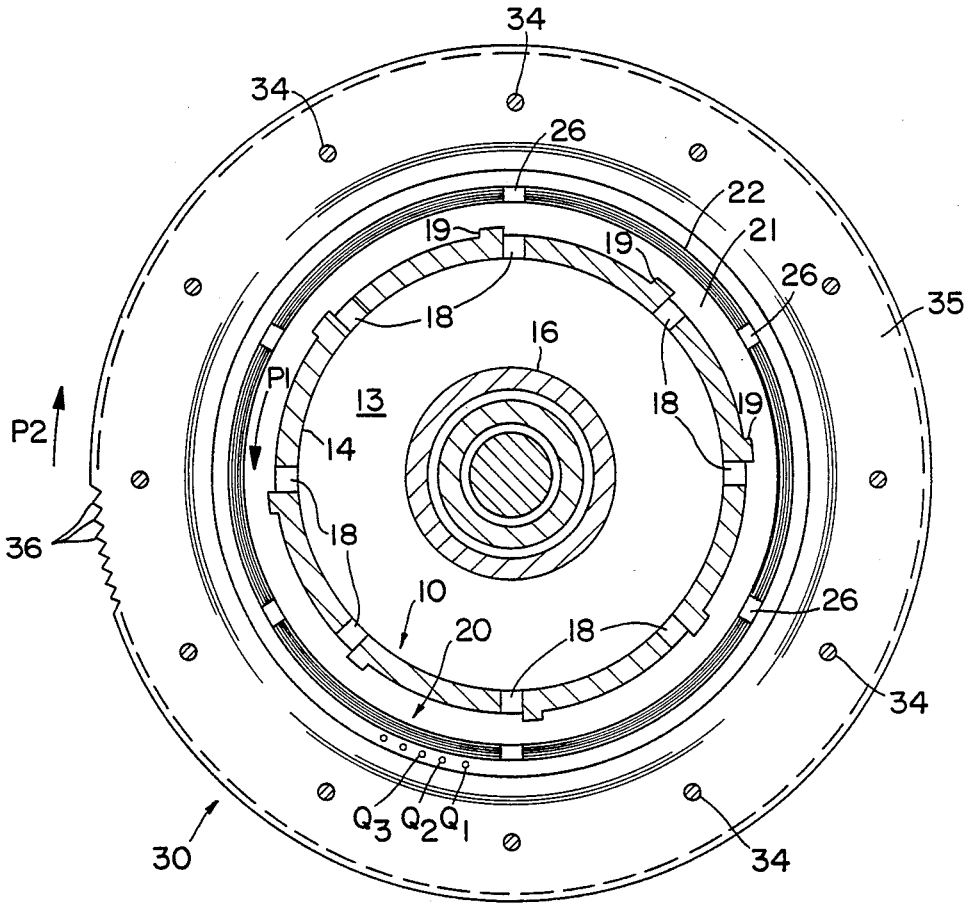
Figure 4:
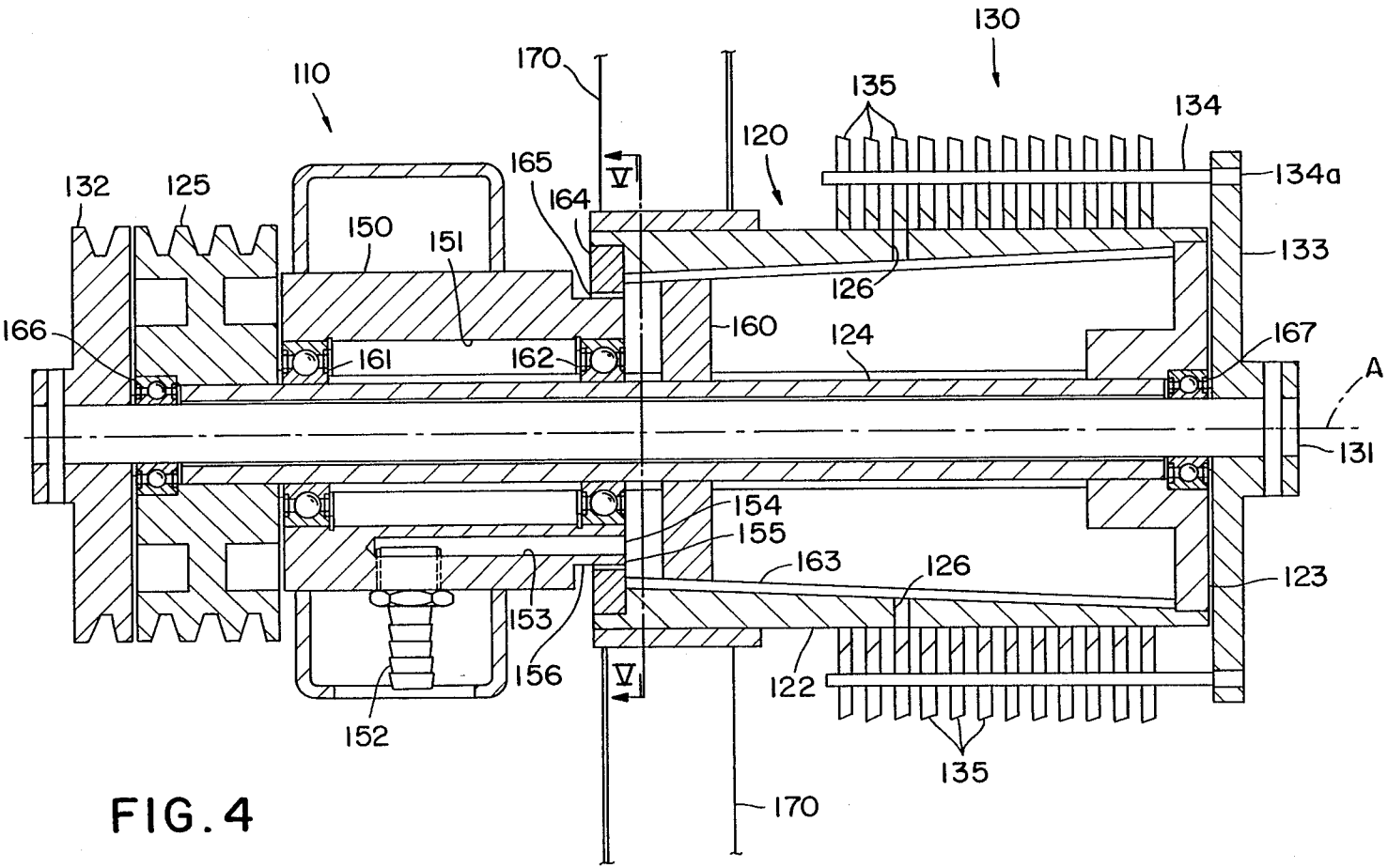
Figure 5:
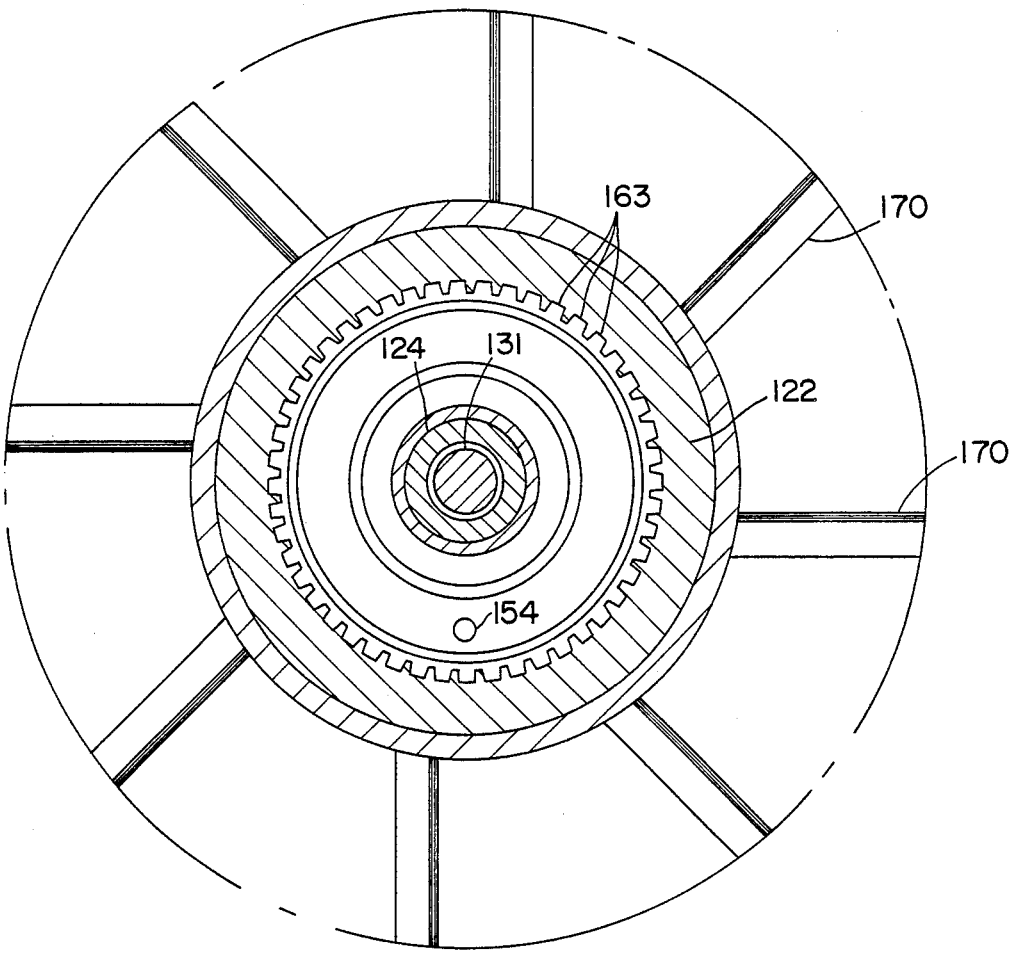

The invention will now be described in more detail, reference being had to two preferred embodiments illustrated in the accompanying drawings in which FIG. 1 is a longitudinal section of a first embodiment of a droplet formation apparatus according to the invention; FIG. 2 is a cross-sectional view along line II—II of the apparatus shown in FIG. 1; FIG. 3 is a cross-sectional view along line III—III of the apparatus shown in FIG. 1; FIG. 4 is a longitudinal section of a second embodiment of a droplet formation apparatus according to the invention; and FIG. 5 is a cross-section along line V—V of the apparatus shown in FIG. 4.

Reference is now made to FIGS. 1–3 illustrating a first preferred embodiment of a droplet formation apparatus according to the invention. This apparatus is especially useful for that application of the invention where nonyielding spherical granules are to be formed from a melt. The apparatus can be supplied with, for example, a melt, such as urea, and can divide the melt into uniform size droplets which in the nonsolidified state are slung out by centrifugal action from the apparatus and solidify during their subsequent passage through a solidification zone. The droplet formation apparatus illustrated may be mounted e.g. at the top of a so-called prilling tower (not shown) through which cooling air is flowing in order to dry the descending droplets slung out by the droplet formation apparatus.

The droplet formation apparatus of FIG. 1 comprises three principal means, viz. a stationary receiving means generally designated 10, a rotatable distributing and dosing means generally designated 20, and a rotatable disk means generally designated 30. These three principal means 10, 20 and 30 are mounted concentrically and in a compact manner about a vertical geometrical axis A.

The stationary receiving means 10 comprises an upper circular cylindrical inlet container 11 which, via peripheral openings, communicates with inlet ducts 12, as shown in FIG. 1, and an outlet container 13 located beneath the inlet container 11 and formed with an annular inner space defined by a cylinder 14, a radial bottom 15 and a pipe 16 which is concentric with the axis A. The inner annular space of the outlet container 13 communicates with the inlet container 11 via a central opening 17 formed in the latter. The pipe 16 which in the embodiment illustrated is stationary, also extends upwardly through the inlet container 11, as shown in FIG. 1.

The cylindrical circumferential wall 14 of the outlet container 13 is formed with a number of elongate vertical outlet slots 18 uniformly distributed around the circumference of the cylinder 14. As will be seen from FIG. 3, the embodiment illustrated has eight outlet slots 18. Furthermore, as is best seen from FIG. 3, the cylindrical circumferential wall 14 of the outlet container 13 is provided with vertical and radially projecting lands 19, the number of which corresponds to the number of slots 18. The lands 19 are provided on the outside of the cylinder 14 at and in parallel with each of said outlet slots 18. In the embodiment illustrated, the lands 19 are provided on but one side of each slot 18 but in other embodiments such lands may be provided, if desired, on both sides of the slots 18. The function of the lands 19 will be described hereinbelow.

The rotatable distributing and dosing means 20 consists substantially of a rotatable dosing container 21 which is formed by an outer cylindrical circumferential wall 22, a radial bottom 23, and a vertical driving pipe 24. As can be seen from FIGS. 1 and 3, the driving pipe 24 is mounted rotatably and concentrically within the stationary pipe 16, and the inner diameter of the circumferential wall 22 is larger than the outer diameter of the inner cylinder 14, such that there is formed, between the stationary outlet container 13 of the receiving means 10 and the rotating circumferential wall 22 of the distributing means 20, an annular space which, via said outlet slots 18, communicates with the central outlet container 13.

At its upper end, which is located above the inlet container 11 and the upper end of the stationary pipe 16, the driving pipe 24 of the distributing means 20 is fixedly connected with a first driving wheel 25 adapted to be drivingly connected with driving means (not shown) for rotating the distributing means about the axis A, as shown by the arrow P1 in FIG. 3.

The cylindrical circumferential wall 22 of the dosing cylinder 21 is formed with a number of axially spaced apart horizontal rows of dosing openings 26 which constitute discharge openings from the annular space in the dosing container 21. In the embodiment illustrated, each such horizontal row of dosing openings 26 comprises six equidistantly distributed dosing openings, as shown in FIG. 3. However, it will be appreciated that the number of dosing openings can be varied in dependence upon the application at issue.

The rotatable disk means 30, finally, comprises a rotatable driving shaft 31 which is rotatably mounted within the rotatable driving pipe 24 and which, at its upper end, is fixedly connected with a second driving wheel 32, a hub 33 mounted at the lower end of the driving shaft 31 and radially extended below the bottom 23 of the dosing container 21, a plurality of circumferentially distributed, axially directed rods 34 received with their lower ends **34*a* in openings formed in the hub 33 at a radial distance from the cylindrical circumferential wall 22 of the dosing container 21, and a number of horizontal annular disks 35, the number of which corresponds to the number of rows of dosing openings 26, said disks being supported by said rods 34 in a given spaced apart relationship, and each disk having a horizontal outer portion 35*a* and an inner downwardly directed conical portion 35*b* associated with said outer portion. The disks 35 are mounted such that the dosing openings 26 of each row open on a level with the conical portion 35*b* of the corresponding disk 35**.

FIG. 3 illustrates schematically how each disk 35 is provided at its peripheral outer edge with uniform circumferentially equidistant and radially projecting portions 36 which, in the embodiment illustrated, are formed as pointed cusps.

When the apparatus described above with reference to FIGS. 1–3 is used for the formation of droplets from a melt, the melt is introduced through the inlet ducts 12 into the inlet container 11 and flows by gravity down into the stationary outlet container 13 and out through the outlet slots 18.

At the same time, the distributing and dosing means 20 which comprises the first driving wheel 25 and the dosing container 21, is caused to rotate in a first direction P1 by means of the driving means (not shown) actuating the driving wheel 25.

Also the disk means 30 which comprises the second driving wheel 32, the driving shaft 31, the hub 33, the rods 34 and the disks 35, is caused to rotate by means of the driving means not shown, but in a direction of rotation P2 which is opposite to the direction of rotation P1 of the distributing means 20, as is shown in FIG. 3.

The melt in the outlet container 13 will thus flow through the outlet slots 18 out into the dosing container 21 rotating in the direction of the arrow P1. The melt which has flown into this space, is deposited by centrifugal action in the form of a layer on the inside of the circumferential wall 22 of the rotating dosing container 21 and then is slung out through the dosing openings 26 against the conical portion **35*b* of each disk 35. Because of the conical shape of the inner portion 35*b* of the disks 35, the melt will always be dosed onto the upper side of the disks 35**, which is a prerequisite condition for a satisfactory function of the apparatus.

The arrangement of the vertical slots and the rotating dosing container 21 thus provides, on the inside of the circumferential wall 22, a melt layer which is of uniform thickness both vertically and circumferentially, and this in turn implies that the outward flow through the dosing openings 26 will be substantially constant in time and of uniform size for the dosing openings 26 at different levels.

To further improve this advantageous property of the apparatus, the stationary inner cylinder 14 is provided with the above-mentioned lands 19 at the outlet slots 18. The radial extent of the lands 19 is smaller than the radial width of the annular space in the dosing container 21, as will appear from FIG. 3. When the rotating melt layer on the inside of the circumferential wall 22 becomes so thick that it is contacted by the stationary lands 19, further build-up of the layer will be prevented.

As shown in FIG. 3, the lands 19 are mounted on that side of the slots 18 which lies in the direction of rotation P1. In this manner, the lands 19 in conjunction with the slots 18 will function as automatic throttling valves. When a land 19 comes into contact with the said layer, a form of "turbulence" is generated immediately outside the corresponding slot 18, whereby further melt discharge through the slot is prevented, and the flow through the "valve" is throttled. When the thickness of the layer is then reduced, because of the outward flow through the dosing opening 26, the "valve" will be reopened automatically. In this manner, there is always maintained a constant thickness of melt layer on the inside of the circumferential wall 22, i.e. a constant outward flow through the dosing openings 26.

An important property of the droplet formation apparatus described is that the magnitude of the constant outward flow through the dosing openings 26 can be controlled. By increasing or reducing, via the driving wheel 25 and the driving pipe 24, the speed of rotation of the dosing container 21 of the distributing means 20, the centrifugal force acting upon the layer on the inside of the circumferential wall 22, and thus the amount of melt dosed through the dosing openings 26 by unit of time, can be controlled. However, as has been mentioned above, a constant speed of rotation of the distributing and dosing means 20 gives a constant flow to the disks.

As has been mentioned before, also the disks 35 of the disk means 30 are rotating during operation of the apparatus, although in a direction (P2) opposite to that of the dosing container 21. By rotating the disks 35 and the dosing container 21 in opposite directions, it is intended to cause the disks 35 to rotate relative to the dosing openings 26. In this manner, the melt discharged through the dosing openings 26 and impinging on the conical portions **35*b* of the disks 35 can be uniformly distributed across the entire circumference of the disks 35**.

If one assumes that the speed of rotation of the disks 35 relative to the dosing container 21 is thirty revolutions per second, and that there are six dosing openings 26 in each row, as shown in FIG. 3, and if one then views a number of points Q immediately adjacent one another (as illustrated schematically at Q1, Q2 etc. in FIG. 3) on the conical portion **35*b* of one of said disks 35, one finds that each such point Q is supplied 180 times per second (30×6) with melt from the dosing openings, which in actual practice means a continuous flow to each such point Q on the disk 35. The conical portion 35*b* of each disk 35 thus is supplied with a circumferentially continuous flow of melt which is formed, by the rotation of the disk (in the direction P2), into a continuous uniform thickness film which grows outwardly towards the cusps at the outer peripheral edge of the disk 35** and is divided by said cusps into uniform size droplets. At each cusp, a droplet is formed which, while still in the molten state, detaches itself from the cusp when the outwardly directed centrifugal force acting on the droplet exceeds the inwardly directed force of adhesion on the droplet, which occurs when the droplet formed on the cusp has attained a given desired size.

By providing, in accordance with the present invention, the outer peripheral edge of each disk with such cusps, defined droplet formation points or "release points" are formed from which the melt leaves the disk in the form of droplets. Since the release requirement—the centrifugal force must exceed the force of adhesion—is always the same at each droplet formation instant and at each cusp, droplets of exactly the same size are continuously obtained. However, it is pointed out that the droplets obtained would not be of uniform size if the flow to some cusps were greater than to other cusps. If the flow to a given cusp is greater than to other cusps, this cusp will produce droplets of a relatively larger diameter, as will appear from the formula below. Thus, the active distribution of the melt at the conical portions **35*b* of the disks 35** is a prerequisite condition for uniform size droplets.

The droplet dimension can be calculated empirically from the following equation:

$$d = 1.87 \times \frac{Q^{0.44} \times \sigma^{0.15} \times \mu^{0.017}}{D^{0.8} \times \omega^{0.75} \times \delta^{0.16}}$$

wherein:

Q=flow per cusp ($m^3/s$)
$\delta$=density ($kg/m^3$)
$\mu$=dynamic viscosity ($Ns/m^2$)
$\sigma$=surface tension (N/m)
D=diameter of rotating body (m)
$\omega$=angular velocity (rad./s)

As has been mentioned above, the droplet formation apparatus described with reference to FIGS. 1–3 is suitable for the production of nonyielding spherical granules from a melt. In such cases, it is frequently desired to produce a large total volume or weight of droplets per unit of time, for example in the order of 10 tons/ hour. In other applications of the invention, where the droplets are not to be solidified after the droplet formation, for example in gas purification, it may instead be desired to produce a large number of relatively smaller droplets per unit of time, but with an essentially lower liquid flow through the apparatus than in the first case. For example, it may be desired in gas purification to have a total liquid flow through the apparatus of 3 litres/min with a droplet diameter in the order of 0.1 mm, which corresponds to about 100 million droplets/second.

The droplet formation apparatus as shown in FIGS. 1–3 is less suitable for smaller liquid flows, for the following reason:

In the droplet formation apparatus according to FIGS. 1–3, it is a condition for uniform size droplets that a constant thickness of the liquid layer on the inside of the circumferential wall 22 is maintained because otherwise there will be no constant outward flow through the dosing openings 26, i.e. a uniform thickness layer on the disks. If the flow through the apparatus is reduced considerably, the liquid layer on the inside of the rotating circumferential wall 22 will be so thin that it is difficult or impossible to maintain a constant layer thickness, and this in turn means that the uniform distribution of the liquid on the disks, which is necessary for uniform size droplets, it not obtained.

To solve this problem, the invention proposes a second embodiment of a droplet formation apparatus which is especially suitable for producing, from a smaller liquid flow, a large number of relatively small droplets per unit of time. A droplet formation apparatus of this type will now be described in more detail with reference to FIGS. 4 and 5. To simplify the description of this second embodiment of the invention, those parts of FIGS. 4 and 5 which occur already in FIGS. 1–3 and have essentially the same function, have been given the same reference numerals, plus 100.

As in the first embodiment, the droplet formation apparatus of FIG. 4 comprises three principal means, viz. a stationary receiving means generally designated 110, a rotatable distributing and dosing means generally designated 120, and a roratable disk means generally designated 130. The three principal means 110, 120 and 130 are arranged concentrically in a compact manner about a horizontal geometrical axis A.

The stationary receiving means 110 comprises a bearing housing 150 with an inner duct 151 concentric with the shaft A. The bearing housing 150 is provided with a hose nipple 152 which is in liquid communication with an inner bore 153 in the bearing housing. The bore 153 extends from the radially inner end of the hose nipple 152 to an opening 154 in one end 155 of the bearing housing 150. At the same end 151, the bearing housing has a radial recess 156.

The rotatable distributing and dosing means 120 consists essentially of a rotatable cylinder 122 having a bottom 123 at its end facing away from the receiving means 110, a supporting disk 160 at its other end, and a driving pipe 124 which is fixedly connected with the cylinder 122 via the bottom 123 and the supporting disk 160. The driving pipe 124 is rotatably mounted concentrically within the inner duct 151 of the bearing housing 150 via bearings 161 and 162. Furthermore, the driving pipe 124 is fixedly connected, at its left-hand end in FIG. 4, with a belt pulley 125 which is driven by driving means (not shown) for rotation of the dosing means 120.

The interior of the cylinder 122 is conical, the wider part facing away from the receiving means 110. The conical inner surface has a number of circumferentially uniformly spaced apart, identical grooves 163. Each groove 163 is defined at one end by the bottom 123 and at the other end by an angular cover disk 164. The cover disk 164 has a central conical hole 165 accommodating the narrow end 155, 156 of the bearing housing 150. Each groove 163 communicates with a radial dosing duct 126 formed in the cylinder 122. The dosing ducts 126 are uniformly distributed both circumferentially and axially.

The rotatable disk means 130, finally, comprises a rotatable driving shaft 131 rotatably mounted within the driving pipe 124, by means of bearings 166, 167. The driving shaft is fixedly connected at one end with a belt pulley 132, a hub 133 mounted at the other end of the driving shaft 131 and radially extended below the bottom 123 of the cylinder 122, a number of circumferentially distributed rods 134 accommodated at one end **134*a* in openings formed in the hub 133 at a radial distance from the cylinder 122, and a plurality of annular disks 135, the number of which, as seen in the axial direction, corresponds to the number of dosing ducts 126. The disks 135 have essentially the same appearance as the disks 35 in the embodiment according to FIGS. 1–3** and are therefore not described in detail.

Like the dosing openings 26, the dosing ducts 126 open at the liquid-receiving surfaces of the disks 135. The apparatus according to FIGS. 4 and 5 has forty-eight grooves 163 and twelve disks 135. In the embodiment illustrated, each groove 163 "serves" but one disk 135, which means that there are forty-eight dosing ducts 126, which gives four ducts 126 per disk.

When the apparatus shown in FIGS. 4 and 5 is used for the formation of liquid droplets, the liquid is introduced through the hose nipple 152 to the bore 153 in the stationary bearing housing 150 from which the liquid flows out through the opening 154 and into the cylinder 122. As in the embodiment first above described, the dosing means 120 and the disk means 130 are caused to rotate both relative to one another and relative to the receiving means 110. Provided that the speed of rotation of the cylinder 122 is sufficiently high, or in other words if the centrifugal force acting on the liquid within the cylinder 122 is sufficiently large, the liquid exiting through the opening 154 will be collected by the grooves 163 for further conveyance to the dosing ducts 126. Since the grooves 163 are identical and uniformly distributed circumferentially, the liquid flow will be divided uniformly in the grooves 163, and if the speed of rotation of the dosing means 120 is sufficiently high, a balanced liquid flow will leave the dosing ducts 126 and flow to the disks 135. In analogy with what has been explained above with reference to the points Q1–Q3 on the disks 35 in FIG. 3, it can be shown that a radially outwardly growing liquid film of uniform thickness is obtainable on each disk 135, which is a prerequisite for uniform size droplets.

The second embodiment of the invention thus makes it possible, in spite of a small liquid flow, to maintain a constant and uniformly distributed liquid flow to the disks. Such a flow is obtained by substituting for the liquid film at the circumferential wall 22 a number of separate liquid flows which are controlled by the grooves 163 and led to the individual dosing ducts 126.

FIGS. 4 and 5 also illustrate a number of "fan blades" 170 fixedly mounted on and radially projecting from the rotating cylinder 122. In this manner, there is obtained, upon operation on the apparatus, an axial air flow adapted to act upon, for example, a gas which is conducted past the apparatus for purification.

It goes without saying that the embodiments described above of the droplet formation apparatus according to the invention can be modified in many ways within the scope of the invention which is limited only by the appended claims. According to one such modification, the apparatus may comprise but one disk if lower capacity is desired.

We claim:

1. A method of dividing a liquid into droplets, the liquid being transferred via a stationary liquid-receiving means (10; 110) to a slinger rotor (30; 130) which is rotated relative to said receiving means (10; 110) about a stationary geometrical axis (A), said slinger rotor (30; 130) having at least one disk (35; 135) extended radially to said axis (A) and having at a radially outer peripheral edge circumferentially equidistant, uniform and radially projecting portions (36) designated cusps hereinbelow, such that the liquid received on the disk (35; 135) is formed into a uniform thickness film which, by centrifugal action, grows radially outwardly toward said cusps (36) and is divided thereby into uniform size droplets, characterised in that the liquid is transferred in a first step from said stationary receiving means (10; 110) to a distribution rotor (20; 120) rotationally independent of said receiving means (10; 110) and said slinger rotor (30; 130); that the liquid in a second step is transferred by the centrifugal force produced by said distribution rotor (20; 120) from said distribution rotor (20; 120) to the disk (35; 135) of said slinger rotor (30; 130) via at least one distribution opening (26; 126) provided in said distribution rotor (20; 120) and located at a radial distance from the axis (A); and that said distribution rotor (20; 120) is rotated about the axis (A) at an angular velocity different from the angular velocity of said slinger rotor (30; 130), in order to uniformly and, relative to the axis (A), circumferentially distribute the liquid transferred through said distribution opening (26; 126) on the disk (35; 135) of said slinger rotor (30; 130).

2. A method as claimed in claim 1, characterised in that the angular velocity of said distribution rotor (20) is controlled for controlling the amount of liquid distributed on the disk (35) per unit of time, and that the angular velocity of said slinger rotor (30) is controlled for controlling the droplet size.

3. A method as claimed in claim 1 or 2, characterised in that said distribution rotor (20; 120) and said slinger rotor (30; 130) are rotated in opposite directions (P1, P2).

4. Method as claimed in any one of claims 1 or 2, characterised in that said uniform size droplets, after being slunged from said slinger rotor (30; 130), are subjected to a solidification process.

5. Method as claimed in any one of claims 1 or 2, characterised in that said uniform size droplets, after being slunged from said slinger rotor (30; 130), are subjected to a drying process.

6. An apparatus for dividing a liquid into droplets, from which apparatus the droplets are slung by centrifugal action, said apparatus comprising a stationary liquid-receiving means (10; 110) adapted to receive the liquid to be divided into droplets;

a slinger rotor (30; 130) rotatable about a stationary geometrical axis (A) and provided with at least one disk (35; 135) projecting radially to said axis (A), said disk being provided at a radially outer peripheral edge with circumferentially equidistant, uniform and radially projecting portions (36) designated cusps hereinbelow; and drive means operatively connected with said slinger rotor (30; 130) and adapted to cause said slinger rotor (30; 130) to rotate about the axis (A) during transfer of the liquid from said receiving means (10; 110) to the disk (35; 135) of said slinger rotor, such that the liquid transferred to said disk (35; 135) is formed into a uniform thickness film which spreads radially towards said cusps (36) and is divided thereby into uniform size droplets, characterised in that said apparatus further comprises a distribution rotor (20; 120) rotationally independent of said receiving means (10; 110) and said slinger rotor (30; 130) for transferring liquid from said receiving means (10; 110) to said slinger rotor (30; 130), said distribution rotor (20; 120) being provided for this purpose with an inner space for receiving liquid transferred from said receiving means (10; 110) and with at least one distribution opening (26; 126) which is in liquid communication with said space and disposed at a radial distance from the axis (A), said distribution opening serving to transfer the liquid within said inner space to the disk (35; 135) of said slinger rotor (30; 130); and said driving means further are adapted to cause said distribution means (20; 120) to rotate about the axis (A) at an angular velocity different from the angular velocity of said slinger rotor (30; 130), such that the liquid within the inner space of said distribution rotor (20; 120) is discharged by centrifugal action through the distribution opening (26; 126) and via said opening is distributed uniformly and, relative to said axis (A), circumferentially on the disk (35; 135) of said slinger rotor (30; 130).

7. An apparatus as claimed in claim 6, characterised in that said slinger rotor (30; 130) comprises a plurality of disks (35; 135) of the type referred to, spaced apart in the direction of the axis (A) and mutually held together, said disks being rotatable about said axis (A) and provided each with a central opening, and that said distribution rotor (20; 120) comprises a distribution cylinder (22; 122) extended through the central openings of said disks (35; 135), the interior of said cylinder forming the said inner space, and the circumferential wall of said cylinder having at least one distribution opening (26; 126) of the type referred to at each of said disks (35; 135).

8. An apparatus as claimed in claim 6 or 7, characterised in that said distribution rotor (20; 120) comprises, for each disk (35; 135), a plurality of distribution openings (26; 126) of the type referred to.

9. An apparatus as claimed in claim 7, characterised in that said drive means are adapted to be controlled in such a manner that the difference between the angular velocity of the slinger rotor (30; 130) and the angular velocity of the distributional rotor (20; 130) is so great that every point (0) on each disk (35; 135) adjacent (35*b*) said distribution openings (26; 126) is supplied with an essentially continuous liquid flow from said distribution cylinder (22; 122).

10. An apparatus as claimed in claim 7, characterised in that said distribution rotor (20) rotates in a given direction (P1);

said stationary receiving means (10) comprises a cylinder (14), the outer diameter of which is smaller than the inner diameter of said distribution cylinder (22), said cylinder being coaxially mounted within the distribution cylinder (22) of said distribution rotor (20), such that an annular space is formed between the stationary cylinder (14) of said receiving means (10) and the rotating distribution cylinder (22) of said distribution rotor (20);

the circumferential wall of the cylinder of said receiving means (10) has a plurality of slots (18) which are essentially parallel to the axis (A) and through which the liquid is adapted to flow out into the said annular space in order to form, by centrifugal action, a liquid layer on the inside of the circumferential wall of the rotating distribution cylinder (22); and the circumferential wall of the cylinder (14) of said receiving means (10) is provided, at and in parallel with each slot (18) formed therein, with a radially projecting land (19) on the side of the slot (18) located in the said direction of rotation (P1), the radial extent of said lands (19) being smaller than the radial width of the annular space, such that the thickness of the said liquid layer is limited by said lands (19) to the radial distance between said lands and the inside of said distribution cylinder (22).

11. An apparatus as claimed in claim 7, characterised in that said receiving means (110) comprises a chamber (153) adapted to receive liquid and having a discharge opening (54) which opens into the interior of said distribution cylinder;

said distribution cylinder (122) is provided on its inside with a plurality of circumferentially spaced apart grooves (163) directed essentially along generatrices of said distribution cylinder (122) and adapted to receive liquid from the discharge opening (154) of said receiving means (110); and each disk (135) has at least one distribution duct (126) which is extended through said distribution cylinder (122), said duct opening at its radially inner end in an associated groove (163) of the said grooves (163) and opening at its radially outer end at the liquid -receiving surface of the disk (135).

12. An apparatus as claimed in claim 11, characterised in that said grooves (163) diverge radially from the point at which liquid is supplied to said grooves (163) from the discharge opening (154) of said receiving means (110), to promote liquid transport via said grooves (163) to said distribution ducts (126) by centrifugal action.

13. An apparatus as claimed in any one of claims 9–12, characterised in that each disk (35; 135) of said slinger rotor (30; 130) has a radially outer portion (35*a*) and a radially inner conical portion (35*b*) connected to said outer portion, said conical portion (35*b*) of each disk being located radially opposite the corresponding distribution opening or openings (26; 126) of said distribution cylinder (22; 122).

14. Granules produced according to the method as follows, wherein a liquid is transferred via a stationary liquid receiving means (10; 110) to a slinger rotor (30; 130) which is rotated relative to said receiving means (10; 110) about a stationary geometrical axis (A), said slinger rotor (30; 130) having at least one disk (35; 135) extended radially to said axis (A) and having at a radially outer peripheral edge circumferentially equidistant, uniform and radially projecting portions (36) designated cusps hereinbelow, such that the liquid received on the disk (35; 135) is formed into a uniform thickness film which, by centrifugal action, grows radially outwardly toward said cusps (36) and is divided thereby into uniform size droplets; wherein the liquid is transferred in a first step from said stationary receiving means (10; 110) to a distribution rotor (20; 120) rotationally independent of said receiving means (10; 110) and said slinger rotor (30; 130); wherein the liquid in a second step is transferred by the centrifugal force produced by said distribution rotor (20; 120) to the disk (35; 135) of said slinger rotor (30; 130) via at least one distribution opening (26; 126) provided in said distribution rotor (20; 120) and located at a radial distance from the axis (A); wherein said distribution rotor (20; 120) is rotated about the axis (A) at an angular velocity different from the angular velocity of said slinger rotor (30; 130), in order to uniformly and, relative to the axis (A), circumferentially distribute the liquid transferred through said distribution opening (26; 126) on the disk (35; 135) of said slinger rotor (30; 130), and wherein the droplets slunged from said slinger rotor (30; 130) are subsequently subjected to a solidifying or drying process.

15. Granules produced according to the method as follows, wherein a liquid is transferred via a stationary liquid receiving means (10; 110) to a slinger rotor (30; 130) which is rotated relative to said receiving means (10; 110) about a stationary geometrical axis (A), said slinger rotor (30; 130) having at least one disk (35; 135) extended radially to said axis (A) and having at a radially outer peripheral edge circumferentially equidistant, uniform and radially projecting portions (36) designated cusps hereinbelow, such that the liquid received on the disk (35; 135) is formed into a uniform thickness film which, by centrifugal action, grows radially outwardly toward said cusps (36) and is divided thereby into uniform size droplets; wherein the liquid is transferred in a first step from said stationary receiving means (10; 110) to a distribution rotor (20; 120) rotationally independent of said receiving means (10; 110) and said slinger rotor (30; 130); wherein the liquid in a second step is transferred by the centrifugal force produced by said distribution rotor (20; 120) to the disk (35; 135) of said slinger rotor (30; 130) via at least one distribution opening (26; 126) provided in said distribution rotor (20; 120) and located at a radial distance from the axis (A); wherein said distribution rotor (20; 120) is rotated about the axis (A) at an angular velocity different from the angular velocity of said slinger rotor (30; 130), in order to uniformly and, relative to the axis (A), circumferentially distribute the liquid transferred through said distribution opening (26; 126) on the disk (35; 135) of said slinger rotor (30; 130), and wherein the droplets slunged from said slinger rotor (30; 130) are subsequently subjected to a solidifying or drying process.

* * * * *